US005954042A

United States Patent [19]

Harvey

[11] Patent Number: 5,954,042

[45] Date of Patent: Sep. 21, 1999

[54] PAINTBALL LOADER

[76] Inventor: Daniel D. Harvey, 1104 Bonnie Brae La., Lake Geneva, Wis. 53147

[21] Appl. No.: 08/966,925

[22] Filed: Nov. 10, 1997

[51] Int. Cl.[6] ..... F41A 9/61

[52] U.S. Cl. ..... 124/51.1; 124/52; 124/48; 124/72

[58] Field of Search ..... 124/51.1, 52, 82, 124/48, 72, 70; 42/54

[56] References Cited

U.S. PATENT DOCUMENTS

| | | | |
|---|---|---|---|
| 4,819,609 | 4/1989 | Tippmann | 124/72 |
| 4,986,251 | 1/1991 | Lilley | 124/67 |
| 5,097,816 | 3/1992 | Miller | 124/49 |
| 5,150,701 | 9/1992 | Wackrow et al. | 124/67 |
| 5,166,457 | 11/1992 | Lorenzetti | 42/49.01 |
| 5,280,778 | 1/1994 | Kotsiopoulos | 124/73 |
| 5,282,454 | 2/1994 | Bell et al. | 124/49 |
| 5,335,579 | 8/1994 | David | 89/34 |
| 5,520,171 | 5/1996 | David | 124/51.1 |
| 5,771,875 | 6/1998 | Sullivan | 124/72 |

*Primary Examiner*—J. Woodrow Eldred
*Attorney, Agent, or Firm*—Andrus, Sceales, Starke & Sawall

[57] ABSTRACT

A loader mountable below the barrel of a semi-automatic paintball gun for feeding a supply of paintballs into the firing chamber of the paintball gun against the force of gravity. The loader includes a mechanically driven rotating paddle wheel that moves the individual paintballs upward and out of the loader housing and into a feed tube. The feed tube connects the outlet of the housing to the firing chamber of the paintball gun such that the combination of the feed tube and paddle wheel continuously supply paintballs to the firing chamber of the paintball gun. The loader includes a motor and a drive spring for rotating the paddle wheel within the housing. The motor winds the drive spring, such that upon a demand for paintballs, the drive spring provides the driving force to the paddle wheel to rotate the paddle wheel within the housing. A motor control circuit monitors the motor such that the motor maintains adequate tension on the spring such that the spring can provide the driving force to rotate the paddle wheel.

24 Claims, 7 Drawing Sheets

10
12
14
16
18
20
22
24
26
28
30
32
36
94
124
126
6
8

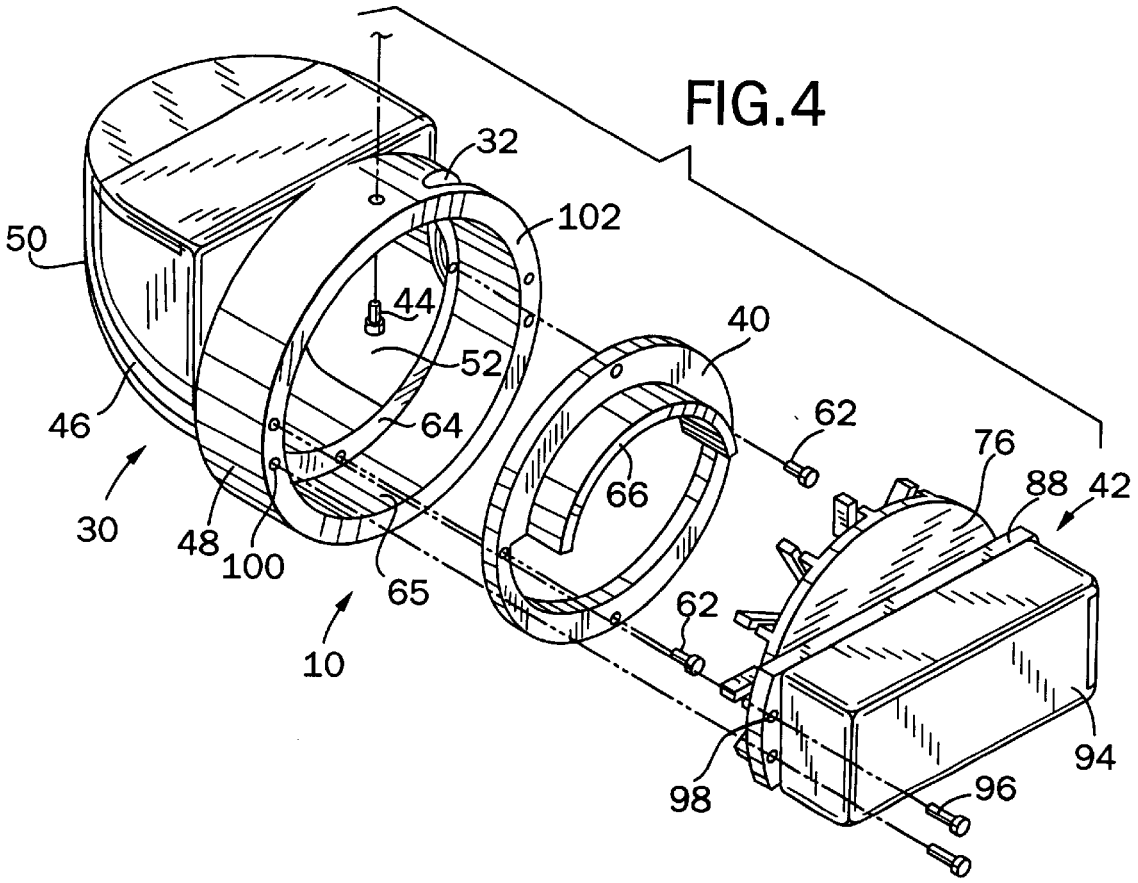
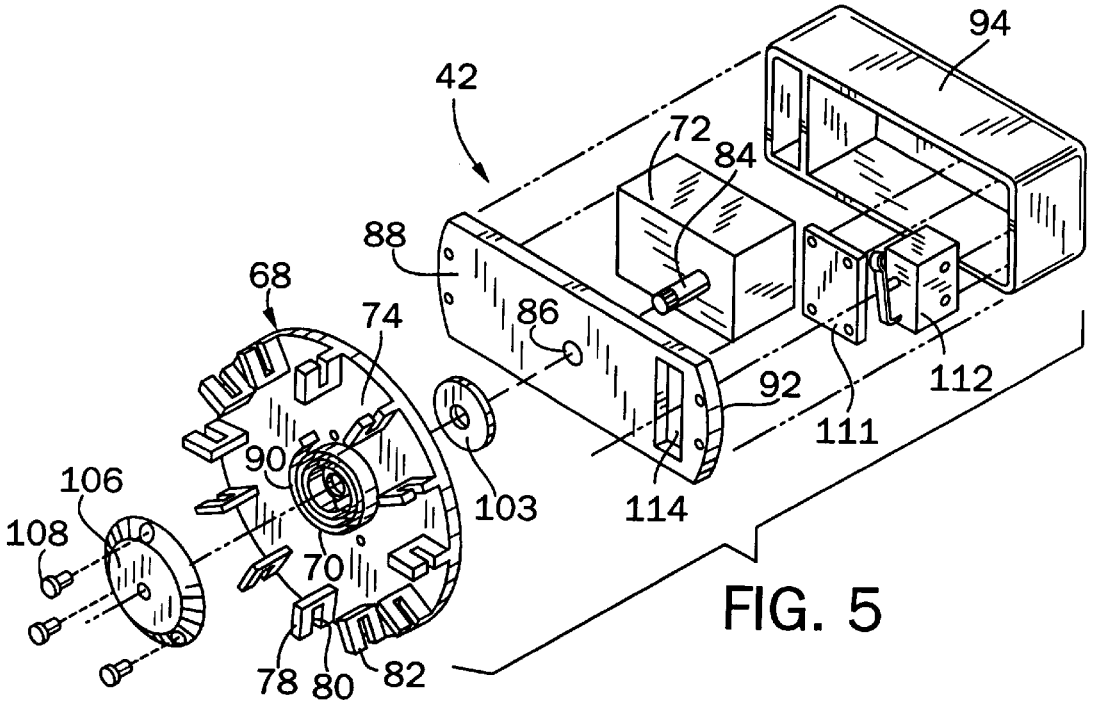
FIG. 5

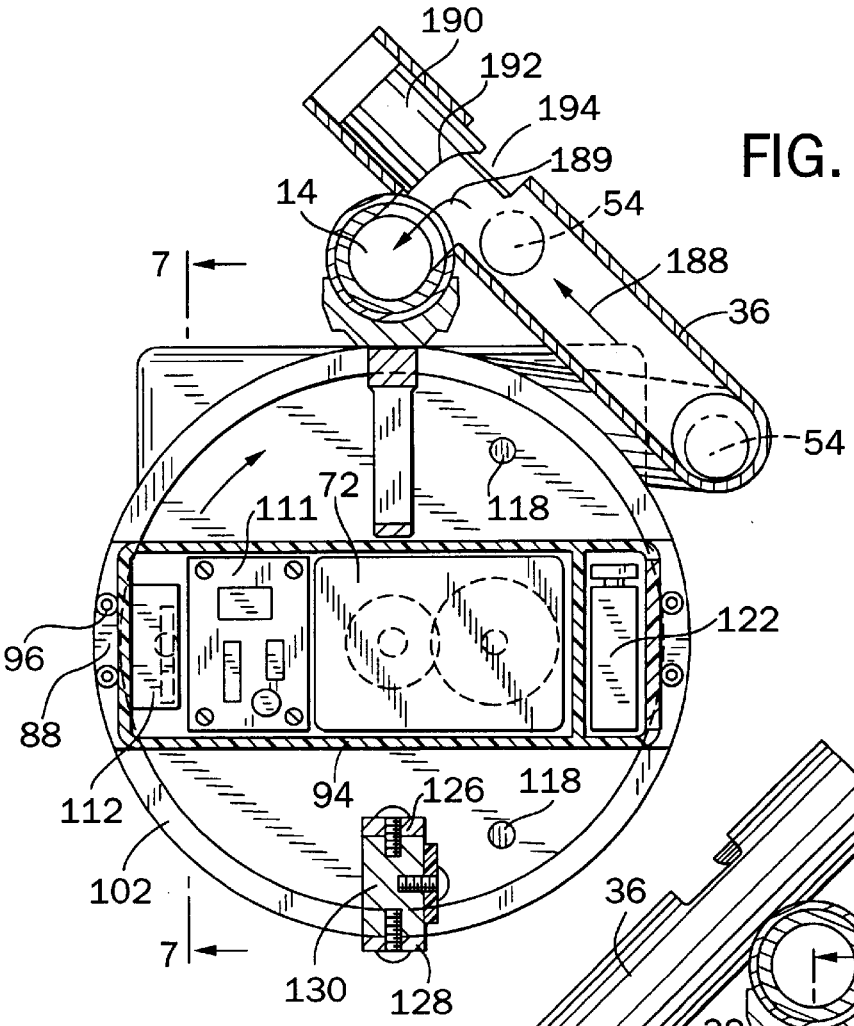
FIG. 6
FIG. 8
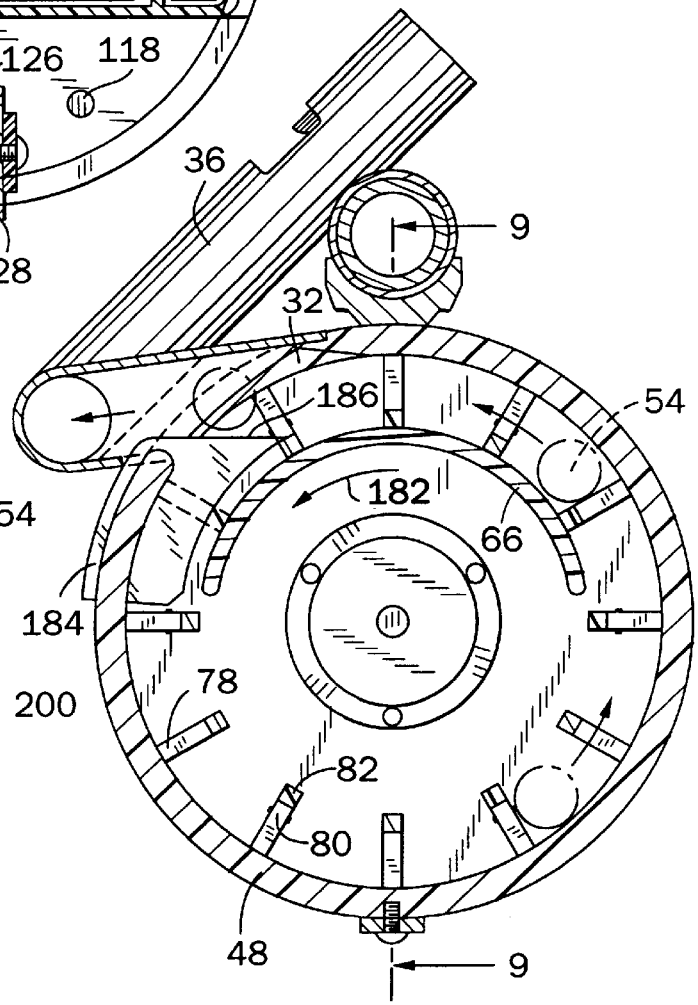
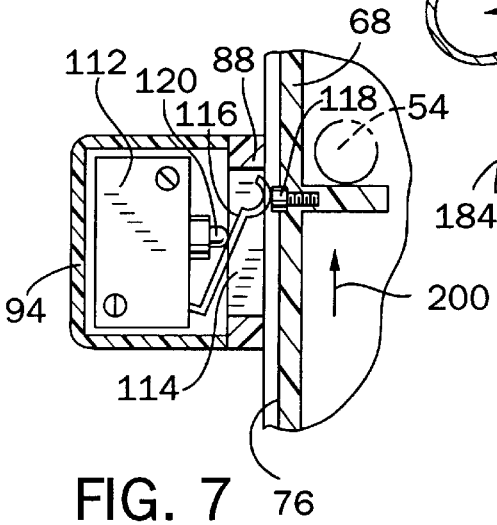
FIG. 7

FIG. 9
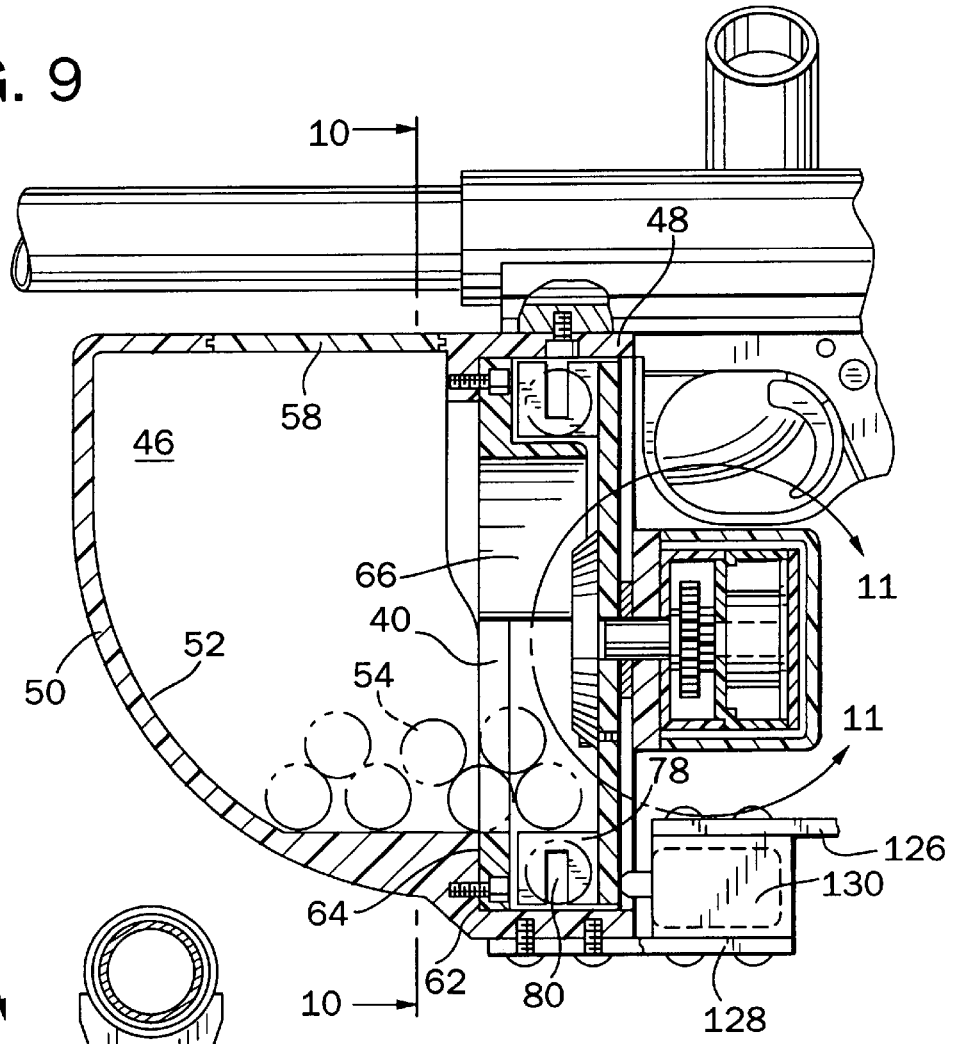
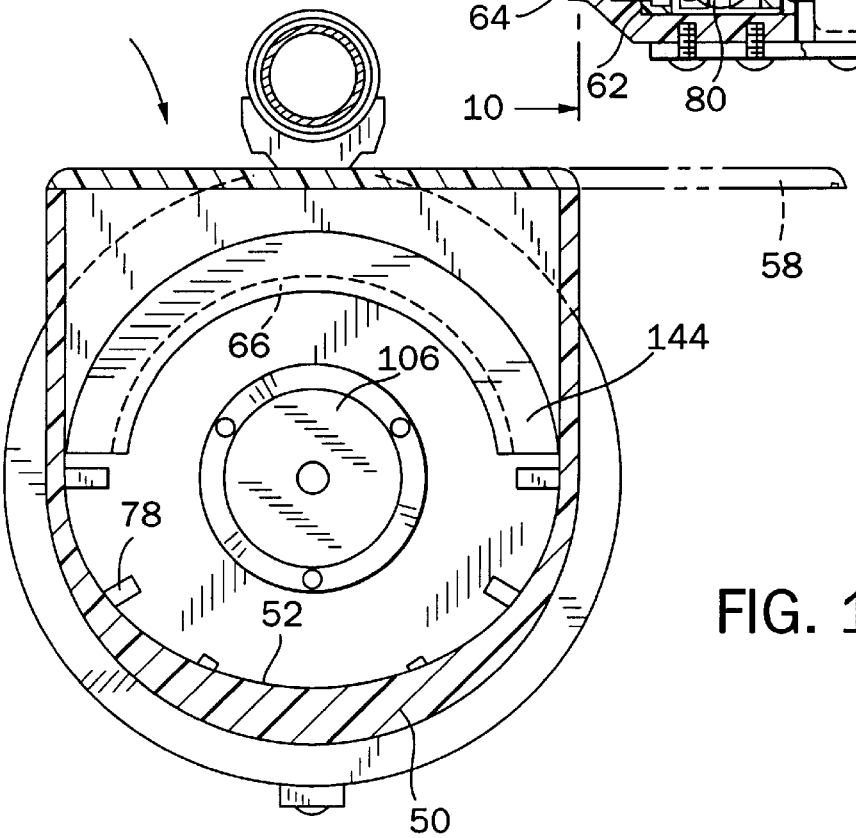
FIG. 10

PAINTBALL LOADER

BACKGROUND OF THE INVENTION

The present invention relates to a paintball gun. More specifically, the present invention relates to a paintball loader that is mountable below the barrel of a paintball gun to sequentially feed a supply of stored paintballs to the firing chamber of the paintball gun.

The game of paintball has enjoyed great success in recent years and is a game in which two or more teams try to capture one another's flags. The players on each of the teams each carry a $CO_2$ powered gun that shoots paintballs that are propelled by short bursts of the pressurized gas. Typically, paintballs are gelatin-covered, spherical capsules having a diameter of approximately 11/16 inch that contain a colored liquid. When a player is hit with a paintball from an opponent's gun, the paintball ruptures and leaves a colored mark on the hit player who then must leave the game.

As the game of paintball has grown in sophistication, semi-automatic paintball guns, guns that sequentially fire paintballs as fast as the trigger can be repeatedly pulled by the user, have become more prevalent. The high firing rate capability of semi-automatic paintball guns has necessitated the use of bulk loader devices in conjunction with such guns.

Typically, a bulk loader device includes a housing which is positioned above and slightly to one side of the paintball gun. The housing is adapted to internally store a relatively large quantity of paintballs (for example, 100–200 paintballs) and has a bottom outlet opening through which the stored paintballs can sequentially drop. A feed tube is connected to the bottom outlet opening of the housing and is connected to the paintball gun's hollow firing chamber.

During normal operation of the loader, paintballs drop through the bottom housing outlet opening, through the feed tube, and into the gun's firing chamber, such that the paintballs are gravity fed to the gun during firing. Paintball jams frequently occur within the loader housing during rapid sequential firing of the gun. These jams prevent the normal gravity delivery of paintballs downwardly through the housing outlet opening, with the result that the paintball stack contained in the feed tube can be totally depleted by several shots of the paintball gun.

In the past, clearing of such jams has required that the gun be forcibly shaken to dislodge the individual paintballs causing the jam within the loader housing. The need to dislodge the jammed paintballs is highly undesirable since it interrupts the user's ability to continually fire the gun.

U.S. Pat. No. 5,282,454 discloses a jam-free bulk loader for a paintball gun that includes an agitator positioned within the loader housing to clear any paintball jams that may occur within the housing. The loader of the '454 patent includes a sensor which determines whether the continuous stream of paintballs to the firing chamber of the gun has been interrupted. If the stream of paintballs has been interrupted due to a jam in the housing, the agitator rotates within the housing to clear the paintball jam and supply paintballs to the gun. The bulk loader in the '454 patent is mounted above the gun such that the paintballs are fed by gravity into the infeed elbow extending off one side of the gun.

While the prior bulk loaders have proven to be relatively effective in rapidly delivering paintballs to a gun for firing, the loaders of the prior art typically sit above the gun and rely on gravity to feed the supply of paintballs to the firing chamber of the gun. When this type of loader is used in paintball games, the rather large loader housing positioned above the gun can be cumbersome and provides a large target for the opposing team to hit. Additionally, since the supply of paintballs are gravity fed, the loader housing must be above the paintball gun, which limits the orientation of the gun during firing. Therefore, it is desirable to provide a paintball loader which can be positioned below the barrel of the gun while still being able to supply paintballs to the firing chamber at the required rate.

BRIEF SUMMARY OF THE INVENTION

The present invention is a paintball loader that can be mounted below the barrel and firing chamber of a paintball gun to continuously supply paintballs to the paintball gun against the force of gravity. The paintball loader of the invention responds instantaneously to a demand for paintballs, such that no interruption occurs in the firing rate of the paintball gun.

The paintball loader of the invention includes a generally hollow housing including a storage bin and a paddle wheel shroud. The housing is a generally hollow structure configured to store a supply of paintballs.

The paintball loader further includes a drive means that is connected to the housing such that the drive means operates to physically transfer the individual paintballs out of the housing and into a feed tube connected between the housing and the paintball gun. The drive means of the invention generally includes a motor, a drive spring, and a paddle wheel. The paddle wheel is a circular member having a series of individual paddles equally spaced around its outer circumference. The paddle wheel is freely rotatable within the paddle wheel shroud contained on the housing of the paintball loader. The downwardly sloped interior configuration of the housing causes paintballs to be directed into the paddle wheel shroud, where the paddle wheel is located.

The drive means of the paintball loader is controlled by a motor control circuit that operates the motor based on certain parameters associated with the motor. The motor includes a drive shaft which is coupled to the paddle wheel through a drive spring. As the drive shaft of the motor rotates, the drive shaft winds the drive spring connected to the paddle wheel. As the drive spring is wound, the energy stored in the windings of the drive spring causes the paddle wheel to rotate and force the individual paintballs out of the housing through an outlet opening.

A wedge member is positioned across the outlet opening and extends into the paddle wheel shroud. The wedge member passes through a slot contained in each of the individual paddles to cause the paintballs to be diverted from the paddle wheel into the feed tube. As the paddle wheel continues to rotate, a continuous string of paintballs backs up between the firing chamber of the paintball gun and the outlet opening of the housing. Once a continuous string of paintballs is present, the paddle wheel is prevented from further rotating. When the paddle wheel is in a stationary position, the motor continues to wind the drive spring until the amount of force required to wind the drive spring exceeds the maximum torque the motor can supply, thereby causing the motor to stall. As the motor begins to stall, the motor control circuit senses the increased current draw and turns the motor off.

When the user of the paintball gun fires a paintball, the drive spring begins to unwind, causing the paddle wheel to rotate and force another paintball into the firing chamber. After a predetermined number of shots have been fired, a rotational indicator connected to the motor control circuit causes the motor to be turned on to wind the spring to the desired tension. After the drive spring again reaches the desired tension, the motor control circuit turns the motor off until the predetermined number of shots have again been fired. In this manner, the motor control circuit maintains the drive spring at a relatively constant tension.

Other features and advantages of the invention may be apparent to those skilled in the art upon inspecting the following drawings and description thereof.

BRIEF DESCRIPTION OF THE DRAWINGS

The drawings illustrate the best mode presently contemplated of carrying out the invention.

In the drawings:

FIG. 4 is an exploded rear perspective view of the paintball loader of the present invention;

FIG. 5 is an exploded view of the motor and paddle wheel of the paintball loader of the present invention;

FIG. 6 is a sectional view taken along line 6—6 of FIG. 1 showing the mounting of the electronics and motor of the paintball loader of the present invention;

FIG. 7 is a sectional view taken along line 7—7 of FIG. 6 showing the rotational indicator of the paintball loader;

FIG. 8 is a sectional view taken along line 8—8 of FIG. 1 showing the operation of the paddle wheel of the paintball loader;

FIG. 9 is a sectional view taken along line 9—9 of FIG. 8;

FIG. 10 is a sectional view taken along line 10—10 of FIG. 9;

DETAILED DESCRIPTION OF THE DRAWINGS

Figure 1:
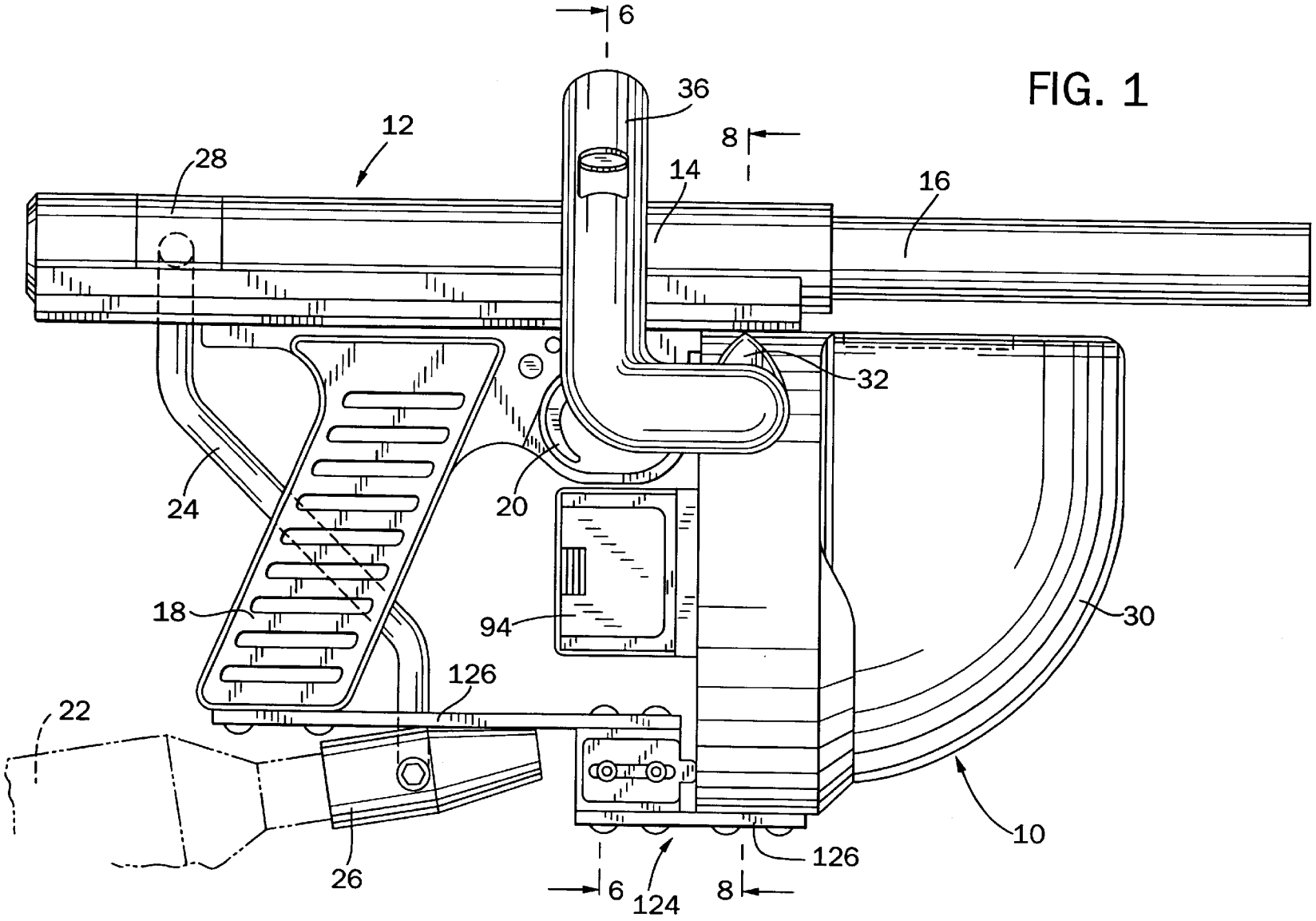
FIG. 1 is a side elevation view of the paintball loader of the present invention as operatively mounted to a paintball gun.

Referring initially to FIG. 1, the paintball loader of the present invention is referred to by reference numeral 10. The paintball loader 10 is shown as operatively mounted to a paintball gun 12 of conventional construction and operation, as is shown and described in U.S. Pat. No. 5,280,778 incorporated herein by reference. The paintball gun 12 is representative of a semi-automatic firing type having a firing chamber 14, a barrel 16, and a handgrip 18 having a trigger 20. The paintball gun 12 is connected to a supply of pressurized $CO_2$ contained within a canister 22. The pressurized $CO_2$ in canister 22 is supplied to the paintball gun 12 by a supply hose 24 extending between a fitting 26 and the rear portion 28 of the paintball gun 12. Although the canister 22 is shown in phantom as directly connected to the fitting 26 of the paintball gun 12, it should be understood that the canister 22 could be located remotely from the paintball gun 12 and connected to the fitting 26 through a flexible hose (not shown).

Figure 3:
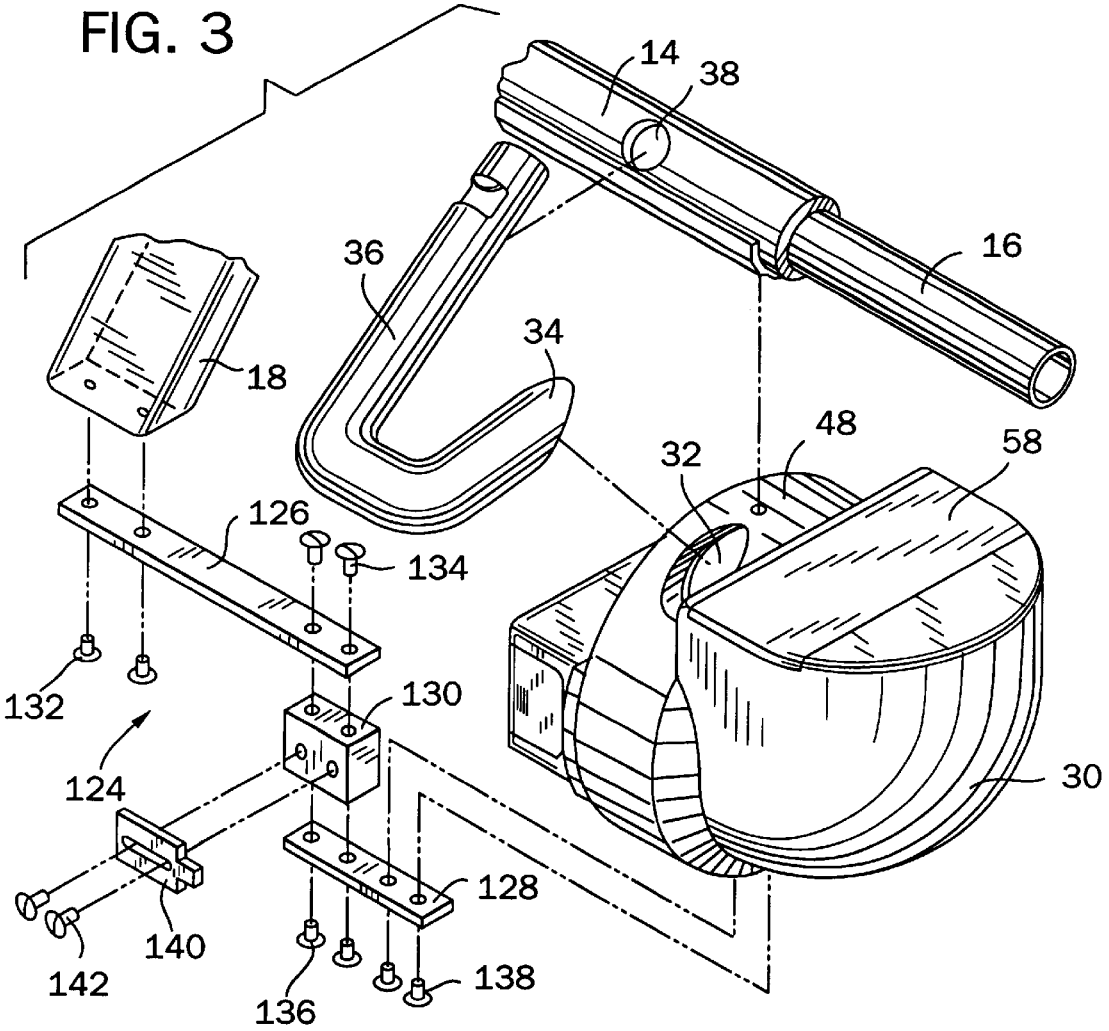
FIG. 3 is an exploded perspective view of the paintball loader and its attachment to the paintball gun.

In general, the paintball loader 10 includes a generally hollow housing 30, mounted below the barrel 16, that functions to store a supply of paintballs. In the preferred embodiment of the invention, the housing 30 is a single member molded from a suitable plastic material having a size large enough to store approximately 100–200 individual paintballs. As shown in FIG. 3, the housing 30 includes an outlet opening 32 that is connected to a first end 34 of a feed tube 36. The feed tube 36 extends from the outlet opening 32 to an entry opening 38 formed in the paintball gun 12. The entry opening 38 provides access to the firing chamber 14 of the paintball gun 12, such that paintballs from the paintball loader 10 can be transferred against the force of gravity through the feed tube 36 and into the firing chamber 14. Once in the firing chamber 14, the paintballs can be sequentially fired from the paintball gun 12 by pressure bursts from canister 22 created by sequential pulls of the trigger 20.

Referring now to FIG. 4, the paintball loader 10 generally includes the housing 30, an intermediate guide member 40 and a drive means 42. The housing 30 is operatively attached below both the barrel 16 and firing chamber 14 of the paintball gun 12 by conventional means, such as a threaded connector 44. In the preferred embodiment of the invention, the housing 30 is a single molded component that includes a hollow storage bin 46 and a paddle wheel shroud 48. The storage bin 46 is defined by an arcuate outer wall 50 that defines a smooth inner surface 52, as is best shown in FIG. 9. The curved, smooth inner surface 52 generally urges the stored supply of paintballs 54 downward and rearward into the paddle wheel shroud 48, where the paintballs 54 are then transported out of the housing 30 through the outlet opening 32, as will be discussed in greater detail below.

Figure 2:
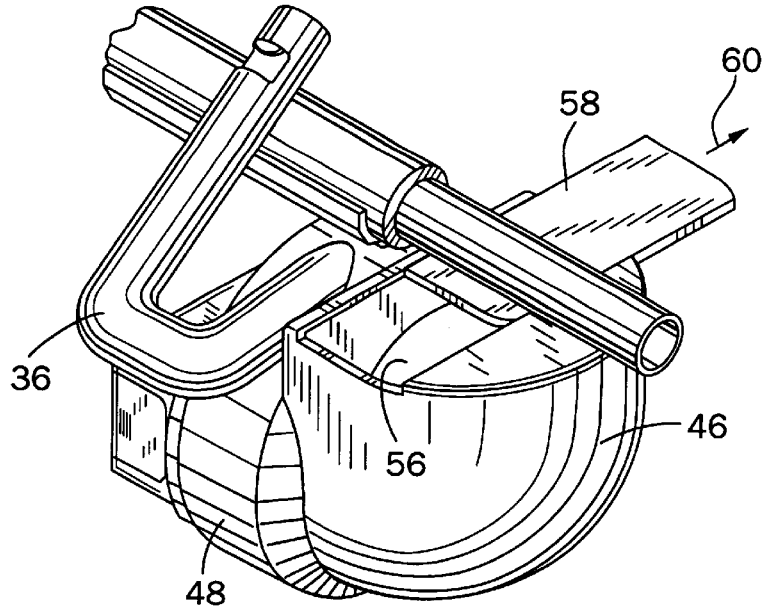
FIG. 2 is a perspective view of the paintball loader of the present invention showing the housing access opening.

Referring now to FIG. 2, the storage bin 46 includes a relatively large access opening 56 that provides access to the hollow interior of the storage bin 46. The access opening 56 includes a removable cover 58 that slides across the access opening 56 of the storage bin 46, as shown by arrow 60. In the preferred embodiment of the invention, the cover 58 is a transparent plastic member, such that the user of the paintball gun 12 can determine the number of paintballs 54 contained within the storage bin 46 during use of the paintball gun 12 while the cover 58 is over the access opening 56.

Referring again to FIG. 4, the guide member 40 is secured within the housing 30 by a series of threaded rivets 62 that are retained in corresponding bores in a shoulder 64 formed between the outermost edge of the storage bin 46 and the paddle wheel shroud 48. As can best be seen in FIGS. 4 and 9, the shoulder 64 is formed by the difference in diameter between the storage bin 46 and the paddle wheel shroud 48. Shoulder 64 varies in height, as shown in FIGS. 4 and 9, since the outer edge of the storage bin 46 does not define an exact circle, unlike the inner surface 65 of the paddle wheel shroud 48. The guide member 40 includes a semi-circular guide plate 66 that extends away from the shoulder 64 and into the paddle wheel shroud 48. The guide plate 66 extends into the paddle wheel shroud 48 almost the entire width of the paddle wheel shroud 48, as will be discussed in greater detail below.

Referring now to FIG. 5, thereshown is the drive means 42 that is used to transport the paintballs 54 out of the housing 30 and into the feed tube 36. Since the paintball loader 10 of the present invention is mounted below both the barrel 16 and firing chamber 14 of the paintball gun 12, the drive means 42 transfers the paintballs 54 out of the housing 30 against the force of gravity. Therefore, the paintball loader 10 of the present invention does not rely on gravity to feed the paintballs 54 to the firing chamber 14 of the paintball gun 12.

The drive means 42 generally includes a paddle wheel 68, a drive spring 70 and an electric motor 72. The paddle wheel 68 is generally circular in shape having a size corresponding to the inner surface 65 of the paddle wheel shroud 48 and includes a generally flat front face 74 and a back face 76. The paddle wheel 68 includes a plurality of individual paddles 78 extending from the front face 74 and equally spaced along the outer circumference of the paddle wheel 68. Each of the individual paddles 78 has a width approximately equal to the width of the paddle wheel shroud 48 and has a height approximately equal to the lowermost portion of shoulder 64, as can be seen best in FIG. 9. Additionally, the paddles 78 are spaced along the outer circumference of the paddle wheel 68 such that the distance between two consecutive paddles 78 is greater than the diameter of a single paintball 54 but less than the diameter of two paintballs, such that only one paintball 54 can fit between successive paddles 78 along the outer circumference of the paddle wheel 68, as shown in FIG. 8. Referring now to FIG. 5, each of the paddles 78 includes a slot 80 extending into the paddle 78 from the outermost edge 82 of the paddle, which is approximately flush with the outer edge of the paddle wheel 68. The significance of the slots 80 will be described in greater detail below.

Referring again to FIG. 5, the motor 72 includes a drive shaft 84 that extends through a hole 86 in a support plate 88 and a corresponding access hole 90 in the center of the paddle wheel 68. The motor 72 is mounted to the back face 92 of the support plate 88 and is encased by a protective cover 94. As can be seen in FIG. 4, the entire drive means 42 is secured to the housing 30 by a plurality of threaded connectors 96 which pass through attachment holes 98 in the support plate 88 and are received in attachment holes 100 in the outer edge 102 of the housing 30. Since only the support plate 88 is fixed to the housing 30, the paddle wheel 68 is freely rotatable within the paddle wheel shroud 48. A washer 103 is positioned between the support plate 88 and the back face 76 of the paddle wheel 68 such that the paddle wheel 68 is freely rotatable with respect to the fixed support plate 88.

Figure 11:
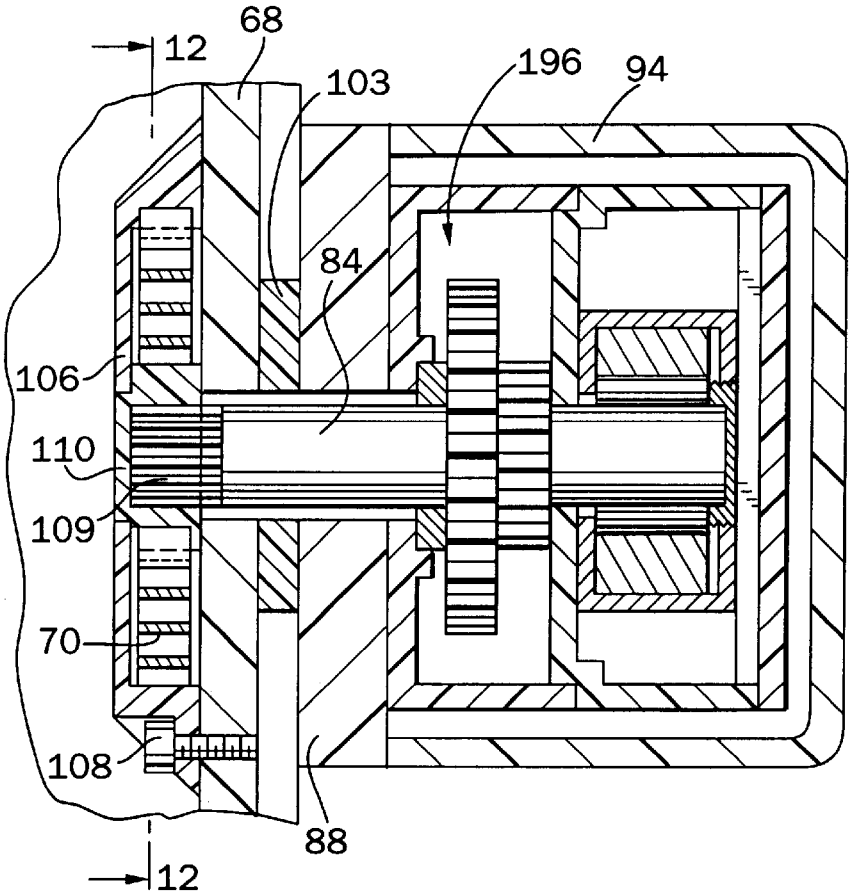
FIG. 11 is a magnified view of the area indicated by line 11—11 of FIG. 10, showing the clutch assembly and motor configuration of the paintball loader.
Figure 12:
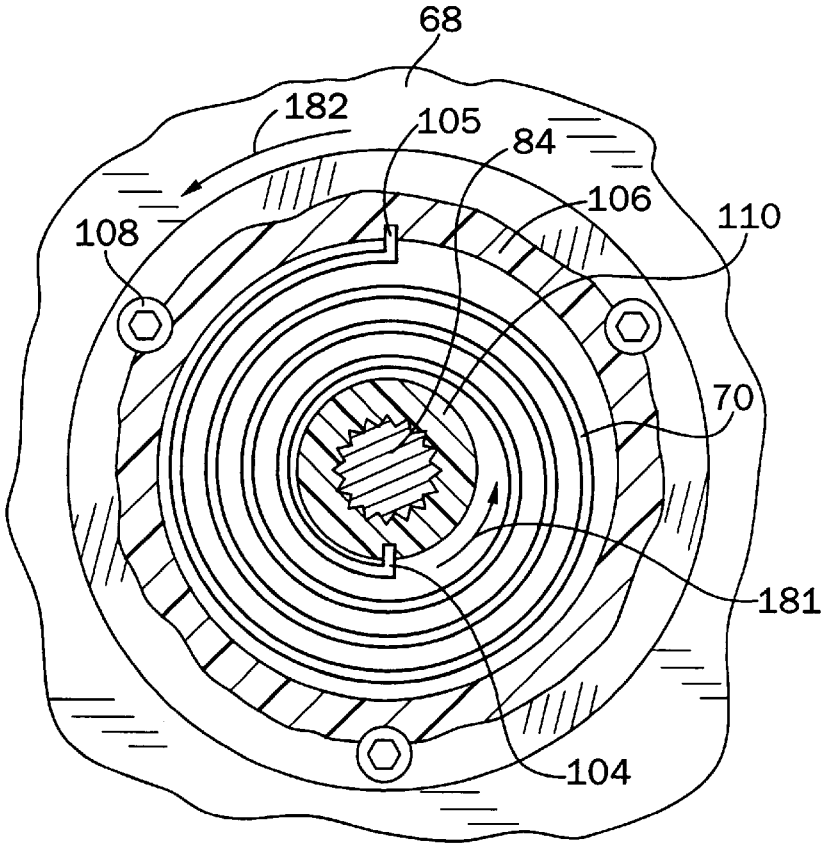
FIG. 12 is a partial sectional view taken along line 12—12 of FIG. 11, showing the drive spring of the paintball loader.

Referring now to FIGS. 11 and 12, the paddle wheel 68 is coupled to the drive shaft 84 of the motor 72 by a drive spring 70. In the preferred embodiment of the invention, the drive spring 70 is a spiral spring having its first end 104 coupled to the drive shaft 84 and its second end 105 fixed to a spring cover 106. In turn, the spring cover 106 is securely fastened to the front face 74 of the paddle wheel 68 by a series of connectors 108, such that the second end 105 of the drive spring 70 is effectively attached to the paddle wheel 68. The drive shaft 84 includes a splined section 109 that engages an end cap 110 on the opposite side of the paddle wheel 68 from the motor 72. In turn, the first end 104 of the drive spring 70 is retained in the end cap 110 such that the drive spring 70 can be wound by the drive shaft 84 through the end cap 110. During operation of the drive means 42, the motor 72 rotates the drive shaft 84, which in turn winds the drive spring 70. As the drive spring 70 is wound, the drive spring 70 exerts a rotational force on the paddle wheel 68 through the spring cover 106, causing the paddle wheel 68 to rotate within the paddle wheel shroud 48. The specific operation of the drive means 42, including the paddle wheel 68, will be discussed in greater detail below.

The drive means 42 further includes a circuit board 111 and a rotational indicator 112. The circuit board 111 includes various electronic components that function to control the operation of the motor 72, as will be discussed in greater detail below with reference to FIG. 13. The circuit board 111 is fixed to the protective cover 94 and is mounted next to the motor 72.

The rotational indicator 112 is also mounted to the protective cover 94 and is aligned with a slot 114 formed in the support plate 88. In the preferred embodiment of the invention, as shown in FIG. 7, the rotational indicator 112 is a simple switch including a trip arm 116. The trip arm 116 extends through the slot 114 formed in the support plate 88 such that the trip arm 116 contacts the back face 76 of the paddle wheel 68. In the preferred embodiment of the invention, the paddle wheel 68 includes a series of indicator pegs 118 that extend from the back face 76 of the paddle wheel 68. As the paddle wheel 68 rotates, the pegs 118 contact the trip arm 116, which in turn depresses the plunger 120, thereby closing a pair of contacts in the rotational indicator 112. In the preferred embodiment of the invention, the rotational indicator 112 is in communication with the electronic components mounted to the circuit board 111 as will be discussed in greater detail below.

In addition to the components already described, the drive means 42 further includes a power supply 122, as shown in FIG. 6. The power supply 122 is mounted within the protective cover 94 and provides power for both the motor 72 and the electronic components on the circuit board 111. In the preferred embodiment of the invention, the power supply 122 is a conventional 9 volt battery.

Referring now to FIGS. 1 and 3, the paintball loader 10 can further include a support structure 124 extending between the handgrip 18 and the bottom of housing 30. The support structure 124 includes a first support bar 126 and a second support bar 128 joined to each other by a spacer 130. The first support bar 126 is securely joined to the handgrip 18 by a pair of connectors 132 and to the spacer 130 by a second pair of connectors 134. The second support bar 128 is joined to the spacer 130 by a pair of connectors 136 and to the bottom of the housing 30 by a second pair of connectors 138. The support structure 124 is used to stabilize the paintball loader 10 and to provide a point of connection for the fitting 26. In one embodiment of the invention, the support structure 124 can include a guide member 140 secured to the spacer 130 by a pair of connectors 142. The guide member 140 provides further stabilization for the housing 30.

Referring now to the Figures, the specific description of how the paintball loader 10 functions to supply paintballs 54 to the paintball gun 12 will now be discussed. Initially, the housing 30 is attached to the paintball gun 12 below both the firing chamber 14 and the barrel 16 by the threaded connector 44 and the support structure 124. After the paintball loader 10 is securely connected to the paintball gun 12, the feed tube 36 is attached between the outlet opening 32 of the housing 30 and the entry opening 38 to the firing chamber 14.

After attaching the feed tube 36, the cover 58 is slid away from the access opening 56 to the storage bin 46, as shown in FIG. 2. With the access opening 56 uncovered, a supply of paintballs 54 can be poured into the housing 30 through the access opening 56.

Once the supply of paintballs 54 is in the housing 30, the curved inner surface 52 of the storage bin 46 urges the individual paintballs 54 downwardly and rearwardly into the paddle wheel shroud 48 and into contact with the paddle wheel 68, as best shown in FIG. 9. Since the individual paddles 78 on the paddle wheel 68 are spaced apart from each other a distance greater than the diameter of an individual paintball 54, a single paintball 54 will be located between each of the paddles along the outer circumference of the lower half of paddle wheel 68. As can best be seen in FIG. 10, the guide member 40 includes a shield 144 that prevents paintballs 54 from interacting with the individual paddles 78 above the equator of the circular paddle wheel 68 when the storage bin 46 is completely filled. After the storage bin 46 has been sufficiently filled with paintballs 54, the power supply 122 is connected to supply power to the drive means 42 and the circuit board 111. Once the power supply 122 is connected, a motor control circuit 146, as shown in FIG. 13, begins to monitor the status of the motor 72 and operates the motor 72.

Figure 13:
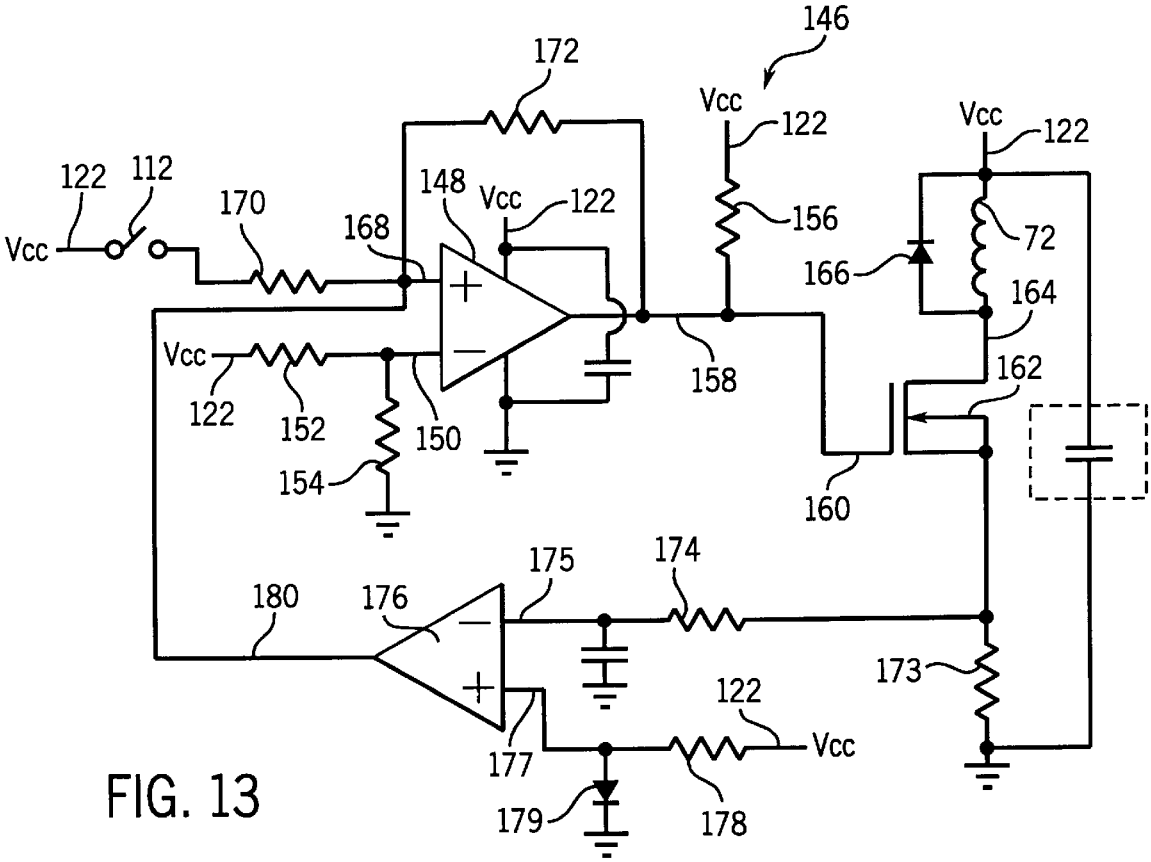
FIG. 13 is a circuit diagram of the motor control circuit of the present invention.

Referring now to FIG. 13, the operation of the motor control circuit 146 will now be discussed. After power has been supplied to the motor control circuit 146, at the locations indicated by Vcc, the comparator 148 will be in its low state due to the reference voltage supplied to its inverting terminal 150 by the voltage divider made up of resistors 152 and 154. When the comparator 148 is in its low state, the voltage supplied through the resistor 156 is effectively connected to ground through the comparator 148. Since the output 158 of the comparator 148 is effectively ground, the gate 160 of the transistor 162 is also grounded, thereby turning off the transistor 162. As graphically depicted in FIG. 13, the motor 72 is connected between the power supply 122 and the drain 164 of the transistor 162, such that current will not be able to flow through the motor 72 when the transistor 162 is off, thereby turning the motor 72 off. A diode 166 is connected across the winding of motor 72 to protect the motor 72 by providing a path for current to flow in the opposite direction around the motor windings.

Turning the motor 72 on requires that the switch contained in the rotational indicator 112 must be momentarily closed. In the preferred embodiment of the invention, the switch in the rotational indicator 112 is momentarily closed by rotating the paddle wheel 68 until one of the indicator pegs 118 contacts the trip arm 116 to depress the plunger 120. When the switch in the rotational indicator 112 is momentarily closed, the power supply 122 is connected to the non-inverting terminal 168 of the comparator 148 through resistor 170. The voltage divider including resistors 152 and 154 is configured such that when the power supply 122 is applied to the non-inverting terminal 168, the voltage at the non-inverting terminal 168 will be greater than the voltage at the inverting terminal 150, such that the comparator 148 will enter its high state, such that the output 158 essentially emulates an open collector. Feedback resistor 172 is connected between the output 158 and the non-inverting terminal 168 of the comparator 148, such that the comparator 148 will latch into its current state until the voltage at the non-inverting terminal 168 is changed.

When the comparator 148 is "high", the voltage across resistor 156 will be applied to the gate 160 of transistor 162. The flow of current through resistor 156 will turn transistor 162 on, allowing current from power supply 122 to flow through the motor 72, thereby turning motor 72 on. When the motor 72 is turned on, current flows through the transistor 162 and to ground through the current sensing resistor 173. Additionally, the voltage generated across the current sensing resistor 173 is applied through resistor 174 into the inverting terminal 175 of comparator 176. The non-inverting terminal 177 of comparator 176 is connected to the power supply 122 through a resistor 178 and diode 179. The diode 179 regulates the voltage applied to the non-inverting terminal 177 such that the current sensing resistor 173 can be selected based on what amount of current is desired to switch the state of comparator 176.

When the motor 72 is initially turned on by the motor control circuit 146, the drive spring 70 is completely unwound, such that the motor 72 can rotate the drive shaft 84 with little resistance from the drive spring 70. Since the motor 72 sees little resistance from the drive spring 70, minimal current is required from the power supply 122. Thus, when the motor 72 is drawing minimal current, the current flowing through the current sensing resistor 173 is relatively small, such that the comparator 176 will be latched to its "high" state by the voltage of the non-inverting terminal 177, thereby allowing the motor control circuit 146 to continue to operate the motor 72. Once the drive spring 70 has been completely wound, the motor 72 will slow down and eventually stall, dramatically increasing the amount of current drawn through the motor 72. During this slow down of the motor, the dramatic increase in current will also flow through the current sensing resistor 173. When the current reaches a predetermined upper limit, the voltage at the inverting terminal 175 of the comparator 176 will exceed the voltage at the non-inverting terminal 177, thereby causing the comparator 176 to be latched at its "low" state. Since the output 180 of the comparator 176 is connected to the non-inverting terminal 168 of comparator 148, this low level will effectively ground the non-inverting terminal 168, causing the comparator 148 to latch at its "low" state, thereby turning off the motor 72. The motor 72 will then remain off until the switch in the rotational indicator 112 is again momentarily closed. In this manner, the motor control circuit 146 operates the motor 72 after the switch in the rotational indicator 112 has been closed and turns the motor 72 off when the current drawn through the motor 72 exceeds a predetermined upper limit, thereby indicating that the drive spring 70 has reached its desired tension.

As previously discussed, the drive spring 70 is positioned between the drive shaft 84 of motor 72 and the spring cover 106 securely attached to the paddle wheel 68. When the drive means 42 is initially turned on, there is little or no tension in the drive spring 70. Thus, the amount of current flowing through the motor 72 is below the upper limit, such that the control circuit 146 allows the motor 72 to continue to operate. When the motor 72 is operating, the drive shaft 84 is rotated in the counter-clockwise direction when viewed from the front, as shown by the arrow 181 in FIG. 12. As the motor shaft 84 rotates in the counter-clockwise direction, the rotation of the drive shaft 84 winds the drive spring 70, thereby causing the drive spring 70 to unwind by rotating the paddle wheel 68 through the spring cover 106.

Since the paddle wheel 68 is freely rotatable within the paddle wheel shroud 48, the paddle wheel 68 begins to rotate in the counter-clockwise direction as shown by arrow 182 in FIG. 8. As the paddle wheel 68 continues to rotate, individual paintballs 54 are moved from the bottom of the storage bin 46 and paddle wheel shroud 48 to the top of the paddle wheel shroud 48. When the paintballs 54 reach approximately the equator of the paddle wheel shroud 48, the combination of the shield 144 and guide plate 66 prevents the paintballs 54 from falling back to the bottom of the paddle wheel shroud 48. As the paddle wheel 68 continues to rotate in the counter-clockwise direction, each of the individual paintballs 54 contacts a wedge portion 184. The wedge portion 184 is inserted into the outlet opening 32 and includes a ramp 186 that contacts each of the paintballs 54 to divert the paintballs 54 out of the space between the individual paddles 78 and into the outlet opening 32. The wedge portion 184 has a thickness slightly less than the width of the slot 80 in each of the individual paddles 78, such that the paddle wheel 68 can freely rotate past the wedge portion 184. Additionally, the wedge portion 184 extends inwardly from the outlet opening 32 a distance approximately equal to the depth of each slot 80 from the outer edge 82 of each individual paddle 78. In this manner, the wedge portion 184 acts to divert the individual paintballs 54 from the paddle wheel 68 and into the feed tube 36.

As the paddle wheel 68 continues to rotate, a continuous supply of paintballs 54 are fed into the feed tube 36. As can best be understood in FIGS. 6 and 8, the continuous supply of paintballs 54 are forced upward into the feed tube 36 toward the connection between the feed tube 36 and the paintball gun 12. Thus, the paintballs 54 are pushed as a continuous string upward against the force of gravity and into the firing chamber 14, as shown by arrow 188 in FIG. 6. As the paintballs 54 travel upward in the feed tube 36, the paintballs contact a plug member 190, which includes a curved contact surface 192, that forces the paintballs 54 downward into the firing chamber 14 as shown by arrow 189. A viewing slot 194 is included in the feed tube 36 near the firing chamber 14, such that the user of the paintball gun 12 can determine if a supply of paintballs 54 is in the feed tube 36.

Once a paintball 54 enters the firing chamber 14, the paintballs 54 begin to back up in the feed tube 36 until the paintballs are positioned in a continuous string extending from the firing chamber 14 to the outlet opening 32 in the housing 30. Once a continuous string of paintballs 54 are present in the feed tube 36, the back up of paintballs prevents the paddle wheel 68 from further rotation in the counter-clockwise direction. Although the paddle wheel 68 is prevented from moving, the drive shaft 84 continues to rotate as previously discussed. Since the paddle wheel 68 is now stationary, the further rotation of the drive shaft 84 causes the drive shaft 84 to wind the drive spring 70. As the drive spring 70 is wound, the torque required for further rotation of the drive shaft 84 increases until the amount of torque required to further wind the drive spring 70 exceeds the capability of the motor, causing the motor to stall, as previously discussed. As the motor 72 begins to slow down and eventually stall, the current flowing through the motor 72 exceeds the upper limit, such that the motor control circuit 146 causes the motor 72 to turn off. In this manner, the motor control circuit 146 controls the amount of stored energy in the drive spring 70.

Since the drive spring 70 is wound to a moderately large tension, a one-way clutch assembly 196, as shown in FIG. 11, is used to prevent the drive spring 70 from unwinding through the motor 72 itself. The one-way clutch assembly 196 is positioned between the motor 72 and the drive shaft 84 such that the motor 72 can drive the drive shaft 84 in the counter-clockwise direction as shown in FIG. 8, while preventing the drive shaft 84 from rotating in the clockwise direction to unwind the drive spring 70. If the one-way clutch assembly 196 were not used, the drive spring 70 could simply unwind through the motor 72 when the motor 72 is off, thereby preventing the drive spring 70 from storing enough energy to rotate the paddle wheel 68.

Once the drive means 42 has loaded the feed tube 36 and the paintball gun 12 as described, the paintball gun 12 and paintball loader 10 are ready for use. As a paintball is fired from the firing chamber 14, the drive spring 70 unwinds in the counter-clockwise direction (arrow 182) to force another paintball 54 to be pushed into the firing chamber 14. Therefore, once a paintball is fired, the drive spring 70 immediately causes another paintball 54 to enter the firing chamber 14. By using the drive spring 70 to drive the paddle wheel 68, the paddle wheel 68 has a constant force applied to it, such that when a paintball is fired, the paddle wheel 68 responds instantly.

As the paintballs 54 are sequentially fired by the paintball gun 12, the paddle wheel 68 rotates in the direction shown by arrow 200 in FIG. 7. As the paddle wheel 68 rotates, one of the indicator pegs 118 contacts the trip arm 116 of the rotational indicator 112. When the trip arm 116 is contacted, the switch in the rotational indicator 112 closes, causing the motor 72 to be turned on by the control circuit 146 as discussed. When the motor 72 is turned on, the motor 72 rotates the drive shaft 84 to wind the drive spring 70 to the desired tension as previously discussed. While the motor 72 is winding the drive spring 70, the control circuit 146 monitors the amount of current drawn by the motor 72 and turns the motor 72 off when the current exceeds the predetermined upper limit. By using the rotational indicator 112 and indicator pegs 118, the drive means 42 keeps the drive spring 70 wound to a relatively constant tension, such that the drive means 42 can adequately supply the required number of paintballs 54 to the paintball gun 12.

It is recognized that various equivalents, alternatives and modifications to the invention as described are possible. Such equivalents, alternatives and modifications should be considered to fall within the scope of the following claims.

I claim:

1. A loader for supplying paintballs to a paintball gun having a barrel and a hollow firing chamber, the loader comprising:

a housing for storing a plurality of paintballs, the housing having an outlet opening;

a feed tube having a first end connected to the outlet opening of the housing and a second end connectable to the firing chamber of the paintball gun;

a paddle wheel rotatably disposed in the housing for feeding the paintballs into the feed tube;

a drive spring having a first end and a second end, the first end of the drive spring coupled to the paddle wheel to provide a driving force to rotate the paddle wheel within the housing; and a motor coupled to the second end of the drive spring, wherein the motor operates to wind the drive spring to maintain sufficient tension in the drive spring as paintballs are discharged by the paintball gun.

2. The loader of claim 1 wherein the paddle wheel is rotatable about an axis parallel to the longitudinal axis of the paintball gun barrel and feeds the paintballs into the feed tube against the force of gravity.

3. The loader of claim 1 wherein the paddle wheel includes a plurality of individual paddles equally spaced along the outer circumference of the paddle wheel.

4. The loader of claim 3 wherein the individual paddles are spaced from each other by a distance greater than the diameter of one paintball and less than the diameter of two paintballs.

5. The loader of claim 3 further comprising a wedge portion mounted to the housing at the outlet opening for diverting the paintballs from the paddle wheel into the feed tube.

6. The loader of claim 5 wherein each of the individual paddles on the paddle wheel include an open slot sized to allow the wedge portion to pass therethrough, such that the paddle wheel is freely rotatable past the wedge portion.

7. The loader of claim 1 wherein the feed tube is upwardly curved from the outlet opening of the housing to the firing chamber of the paintball gun when the loader is operatively mounted to the paintball gun.

8. The loader of claim 1 wherein the housing includes a removable loading cap that provides access to the interior of the housing, said loading cap being below the barrel of the paintball gun.

9. A loader for supplying paintballs to a paintball gun having a barrel and a hollow firing chamber, the loader comprising:

a housing for storing a plurality of paintballs, the housing having an outlet opening;

a feed tube having a first end connected to the outlet opening of the housing and a second end connectable to the firing chamber of the paintball gun;

a paddle wheel rotatably disposed in said housing for feeding the paintballs into the feed tube against the force of gravity;

a drive spring coupled to the paddle wheel to provide a driving force to rotate the paddle wheel;

an electric motor coupled to the drive spring such that the motor is operable to wind the drive spring; and a controller including an electronic circuit that monitors the amount of current drawn by the electric motor and turns off the electric motor when the amount of current drawn exceeds an upper limit.

10. The loader of claim 9 wherein the driving means includes a one-way clutch assembly, the clutch assembly allowing the motor to wind the drive spring while preventing the drive spring from unwinding through the motor.

11. The loader of claim 9 further comprising a rotational indicator connected to the controller, the rotational indicator providing a signal related to the number of rotations of the paddle wheel, such that the controller can operate the electric motor based on the number of rotations of the paddle wheel.

12. The loader of claim 9 wherein the paddle wheel includes a plurality of individual paddles equally spaced along the outer circumference of the paddle wheel.

13. The loader of claim 12 further comprising a wedge portion mounted to the housing at the outlet opening for diverting the paintballs from the paddle wheel to the feed tube.

14. The loader of claim 13 wherein each of the individual paddles on the paddle wheel include an open slot sized to allow the wedge portion to pass therethrough, such that the paddle wheel can freely rotate past the wedge portion.

15. A paintball gun assembly comprising:

a gas-operated paintball gun having an firing chamber for sequentially receiving paintballs to be fired by the gun;

a paintball loader having a housing positioned generally below the gun for receiving and internally storing a plurality of paintballs, the housing having an outlet opening through which the stored paintballs may pass;

a feed tube having a first end connected to the outlet opening of the housing and a second end connected to the firing chamber of the paintball gun;

a paddle wheel rotatably disposed in said housing for feeding the paintballs into the feed tube against the force of gravity, the paddle wheel having a plurality of individual paddles equally spaced along the outer circumference of the paddle wheel;

a drive spring having a first end and a second end, the first end of the drive spring coupled to the paddle wheel;

a motor coupled to the second end of the drive spring, the motor being operable to wind the drive spring, wherein the drive spring can unwind to provide the required driving force to rotate the paddle wheel within the housing; and a controller in operative communication with the motor, the controller operating the motor to maintain a constant tension on the drive spring as paintballs are fed into the feed tube by the paddle wheel.

16. The paintball gun assembly of claim 15 wherein the controller includes means for monitoring the amount of current drawn by the motor, such that the controller turns the motor off when the amount of current exceeds an upper limit.

17. The paintball gun of claim 15 further comprising a wedge portion mounted to the housing at the outlet opening, such that the wedge portion diverts the paintballs from the paddle wheel into the feed tube.

18. The paintball gun assembly of claim 15 further comprising a rotational indicator connected to the controller, the rotational indicator generating a signal related to the amount of rotation of the paddle wheel.

19. A loader for supplying paintballs to a paintball gun having a barrel and a hollow firing chamber, the loader comprising:

a housing for storing a plurality of paintballs, the housing being positionable generally below the barrel and firing chamber of the paintball gun, the housing having an outlet opening located below the infeed passage of the paintball gun;

a feed tube having a first end connected to the outlet opening of the housing and a second end connectable to the infeed portion of the paintball gun;

a paddle wheel rotatably disposed about a horizontal axis within the housing for feeding the paintballs into the feed tube, the paddle wheel having a plurality of individual paddles equally spaced along the outer circumference of the paddle, each individual paddle having an open slot;

a wedge portion mounted to the housing at the outlet opening, the wedge portion positioned to pass through the open slot in each paddle to divert the paintballs from the paddle wheel to the feed tube;

a driving means including a motor and a drive spring for rotating the paddle wheel, the motor winding the drive spring to introduce tension to the drive spring such that the drive spring can exert a driving force on the paddle wheel to rotate the paddle wheel; and a controller operatively connected to the driving means to control the operation of the driving means to maintain a predetermined tension on the drive spring as paintballs are fed into the feed tube by the paddle wheel.

20. The loader of claim 19 wherein the feed tube is upwardly curved from the outlet opening of the housing to the firing chamber of the paintball gun when the loader is operatively mounted to the paintball gun.

21. The loader of claim 1 wherein the motor is operated to maintain a predetermined tension on the drive spring as paintballs are fed into the feed tube.

22. A loader for supplying paintballs to a paintball gun, the loader comprising:

a housing for storing a plurality of paintballs, the housing having an outlet opening;

a paddle wheel rotatably disposed in the housing for feeding the paintballs from the housing to the paintball gun, wherein the paddle wheel rotates to supply one of the paintballs to the paintball gun after one of the paintballs has been discharged by the paintball gun;

a drive spring having a first end and a second end, the first end of the drive spring being coupled to the paddle wheel;

an electric motor coupled to the second end of the drive spring, the electric motor being operable to wind the drive spring wherein when one of the paintballs is discharged by the paintball gun, the drive spring exerts a driving force on the paddle wheel to rotate the paddle wheel and supply one of the paintballs to the paintball gun; and an electronic controller operatively connected to the electric motor, the electronic controller initially operating the drive motor to wind the drive spring to a predetermined tension, and wherein the electronic controller monitors the rotation of the paddle wheel and operates the electric motor to wind the spring back to the predetermined tension after a predetermined number of paintballs have been discharged by the paintball gun.

23. The loader of claim 22 further comprising a rotational indicator coupled to the controller, the rotational indicator generating a signal related to the amount of rotation of the paddle wheel such that the controller can determine the number of paintballs discharged.

24. The loader of claim 23 wherein the electronic controller further includes means for monitoring the amount of current drawn by the electric motor, such that the electric controller determines the tension of the drive spring by monitoring the amount of current drawn by the motor and turns off the electric motor when the amount of current exceeds an upper limit.

* * * * *